US009498019B2

(12) United States Patent
Westmoreland et al.

(10) Patent No.: US 9,498,019 B2
(45) Date of Patent: Nov. 22, 2016

(54) IMPACT ABSORBING SHOE

(71) Applicants: Christopher L. Westmoreland, Raytown, MO (US); JaLonn D. Westmoreland, Raytown, MO (US)

(72) Inventors: Christopher L. Westmoreland, Raytown, MO (US); JaLonn D. Westmoreland, Raytown, MO (US)

( * ) Notice: Subject to any disclaimer, the term of this patent is extended or adjusted under 35 U.S.C. 154(b) by 331 days.

(21) Appl. No.: 14/155,133

(22) Filed: Jan. 14, 2014

(65) Prior Publication Data

US 2015/0196085 A1 Jul. 16, 2015

(51) Int. Cl.

| | |
|---|---|
| ***A41G 1/00*** | (2006.01) |
| ***A43B 13/18*** | (2006.01) |
| ***A43B 7/32*** | (2006.01) |
| ***A43B 13/12*** | (2006.01) |
| ***A43B 7/14*** | (2006.01) |
| ***A43B 13/02*** | (2006.01) |
| ***A43B 13/40*** | (2006.01) |

(52) U.S. Cl.

CPC ..... *A43B 7/32* (2013.01); *A43B 7/149* (2013.01); *A43B 13/02* (2013.01); *A43B 13/026* (2013.01); *A43B 13/125* (2013.01); *A43B 13/127* (2013.01); *A43B 13/187* (2013.01); *A43B 13/40* (2013.01)

(58) Field of Classification Search

CPC ..... A43B 7/32; A43B 13/02; A43B 13/026; A43B 13/04; A43B 13/28

USPC ..... 36/87, 32 A

See application file for complete search history.

(56) References Cited

U.S. PATENT DOCUMENTS

| | | | | |
|---|---|---|---|---|
| 2,400,487 | A * | 5/1946 | Clark | A43B 13/22 36/25 R |
| 4,375,728 | A * | 3/1983 | Dassler | A43B 13/223 36/114 |
| 5,388,349 | A * | 2/1995 | Ogden | A43B 1/0045 36/43 |
| 6,425,195 | B1 * | 7/2002 | Donzis | A41D 31/005 36/114 |
| 7,357,966 | B2 | 4/2008 | Dipple et al. | |
| 2006/0130363 | A1 * | 6/2006 | Hottinger | A43B 3/108 36/28 |
| 2009/0307925 | A1 * | 12/2009 | Pfister | A43B 7/223 36/28 |
| 2009/0313853 | A1 * | 12/2009 | Tadin | A43B 3/0005 36/91 |
| 2010/0242305 | A1 * | 9/2010 | Liu | A43B 3/128 36/102 |
| 2011/0081506 | A1 * | 4/2011 | Lee | C08L 23/12 428/17 |

* cited by examiner

*Primary Examiner* — Jila M Mohandesi
(74) *Attorney, Agent, or Firm* — Hovey Williams LLP

(57) ABSTRACT

Improved impact absorbing shoe constructions are provided which include a composite sole and an attached upper. The sole includes a section of artificial turf having a backing sheet, a plurality of artificial turf grass fibers secured to the backing sheet, and resilient elastomeric infill between the fibers. The resultant shoes provide a comfortable wearing experience while also giving adequate foot and ankle support.

9 Claims, 4 Drawing Sheets

IMPACT ABSORBING SHOE

BACKGROUND OF THE INVENTION

1. Field of the Invention

The present invention is broadly concerned with improved impact absorbing shoes having a section of artificial turf as a part of the soles thereof. More particularly, the invention is concerned with such improved shoes, and midsoles used in the construction of composite shoe soles, wherein artificial turf is embedded within the composite soles of the shoes.

2. Description of the Prior Art

The human foot has 26 bones, 33 joints, 19 muscles, and a number of interconnecting ligaments. These components normally work together in perfect precision and the person is generally unaware of any of these parts. A human foot may strike the ground 10,000 times a day and cover more than 115,000 miles in a lifetime. An average athlete will generate up to 700 lbs of pressure on a foot in a single leap or stride.

There are three energy-storing mechanisms in a human foot. As the Achilles tendon stretches when a person steps down, the tendon stores energy. The release of this energy occurs when the person steps off and the tendon relaxes. The arch of the human foot flattens when a step is taken, thus storing energy, and the arch releases its stored energy when a step is taken. The third mechanism is a cushion under the heel of the foot which acts as a shock absorber and stores energy as it is compressed.

In light of the complexity of the human foot, and the pain which can accompany any foot injuries, considerable research has been done in the past in an effort to provide comfortable, impact absorbing shoes. This is particularly the case for various types of athletic shoes, such as tennis, walking, or running shoes. The modern athletic shoe did not come into existence until the 1970s. Prior to that, consumers wore "sneakers," or rubber-soled shoes with canvas tops. However, beginning in the late 1960s, Nike, Inc. and The New Balance Shoe Company were formed for the purpose of developing improved running shoes. These companies, and many subsequent competitors, developed a bewildering number of athletic shoe types, which we see today. Notwithstanding all of these efforts, there is a continuing search for improved shoes in terms of comfort, support, and overall wearing experience.

Artificial turfs were originally created in the mid-1960s and have also seen a long history of development. The first major commercial product "AstroTurf" was installed in the Houston Astrodome in 1966. Since that time, many improvements have been made, and the patent art is replete with references describing various types and modifications of artificial turfs, see, e.g., U.S. Pat. No. 7,357,966 and Publication No. 2011/0081506. Generally speaking, present-day artificial turfs include a woven backing sheet with a plurality of artificial grass blades sewn into the sheet. These blades are typically formed using polyethylene or similar synthetic resin materials. Additionally, these turfs are provided with an infill between the blades, which include elastomeric rubber particles or crumbs. These artificial turfs closely mimic the characteristics of high-grade natural turfs, but have lower maintenance costs and longer lives.

SUMMARY OF THE INVENTION

It has now been determined that improved impact absorbing shoes can be provided with a composite sole including as a part thereof a section of artificial turf. That is, a typical shoe in accordance with the invention has an upper and a composite sole, wherein a section of artificial turf forms a part of the composite sole. The turf section of the sole has a backing sheet, a plurality of artificial turf grass fibers secured to the backing sheet and extending upwardly therefrom, and resilient elastomeric infill above the backing sheet and between the grass fibers. Structure is also provided to maintain the components of the artificial turf as a part of the composite sole.

Although the invention is not limited to any particular type of shoe, in most instances, athletic shoes are produced in accordance with the invention. According to another aspect of the present invention, such shoes include an upper that is secured to a composite sole and comprises a toe cap, vamp, and collar. The composite sole generally has an outer sole, a midsole, and an insole. The midsole comprises a housing presenting upstanding sidewall structure. The midsole further includes a section of artificial turf within the housing. The artificial turf section includes a backing sheet, a plurality of artificial turf grass fibers secured to the backing sheet and extending upwardly therefrom, and a resilient elastomeric infill above the backing sheet and between the grass fibers. The midsole also includes a cover disposed over the housing to retain the artificial turf section within the housing.

Another aspect of the present invention concerns a midsole including a housing and a section of artificial turf. The housing presents upstanding sidewall structure. The artificial turf section includes a backing sheet, a plurality of artificial turf grass fibers secured to the backing sheet and extending upwardly therefrom, and a resilient elastomeric infill above the backing sheet and between the grass fibers. The midsole also includes a a cover disposed over the housing to retain the artificial turf section within the housing.

In preferred forms, the grass fibers extending above the level of the infill, and the protruding sections of the fibers may be "crushed" during wearing of the shoes. The turf grass fibers are usually formed of synthetic resin material selected from the group consisting of polypropylene, polyethylene, nylon, and mixtures thereof, and have a yarn size of from about five thousand (5,000) to about twelve thousand (12,000) denier. The artificial turf has a pile weight of from about forty (40) to about fifty (50) ounces per square yard. The infill comprises elastomeric natural and/or synthetic rubber polymer particles, which have an average particle size of from about one-tenth (0.1) to about four (4) mm.

This summary is provided to introduce a selection of concepts in a simplified form. These concepts are further described below in the detailed description of the preferred embodiments. This summary is not intended to identify key features or essential features of the claimed subject matter, nor is it intended to be used to limit the scope of the claimed subject matter.

Various other aspects and advantages of the present invention will be apparent from the following detailed description of the preferred embodiments and the accompanying drawing figures.

BRIEF DESCRIPTION OF THE DRAWINGS

Preferred embodiments of the present invention are described in detail below with reference to the attached drawing figures, wherein.

Figure 1:
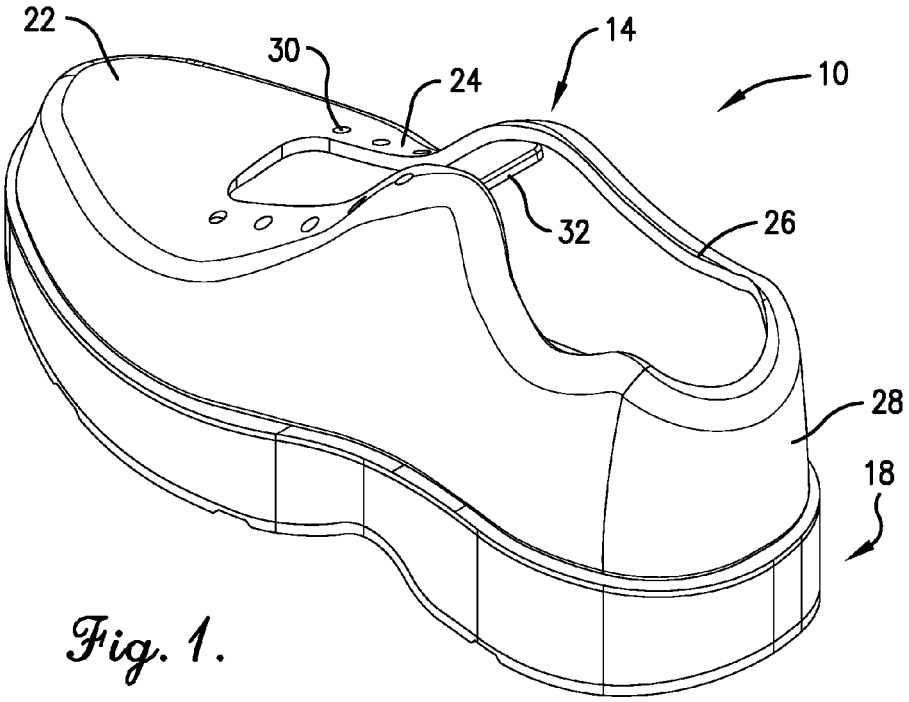
FIG. 1 is a perspective view of an impact absorbing shoe constructed in accordance with a preferred embodiment of the present invention.

The drawing figures do not limit the present invention to the specific embodiments disclosed and described herein. The drawings are not necessarily to scale, emphasis instead being placed upon clearly illustrating the principles of the preferred embodiments.

DETAILED DESCRIPTION OF THE PREFERRED EMBODIMENT

The present invention is susceptible of embodiment in many different forms. While the drawings illustrate, and the specification describes, certain preferred embodiments of the invention, it is to be understood that such disclosure is by way of example only. There is no intent to limit the principles of the present invention to the particular disclosed embodiments.

Turning now to the drawings, and particularly FIG. 1, an impact absorbing shoe 10 is illustrated, which broadly comprises an impact absorbing composite sole 12 and an attached upper 14. The preferred sole 12 includes a lowermost walking surface-engaging outer sole 16, a midsole 18, and an insole 20, which are bonded together to form the sole 12.

The upper 14 in the illustrated shoe includes a toe cap 22, vamp 24, collar 26, and heel section 28. The upper 14 also has lace eyelets 30 and a central tongue 32. Those of ordinary skill in the art will appreciate that the principles of the present are equally applicable to other upper constructions. For example, certain components of the upper may be alternatively designed or altogether eliminated without departing from the spirit of the present invention.

Figure 3:
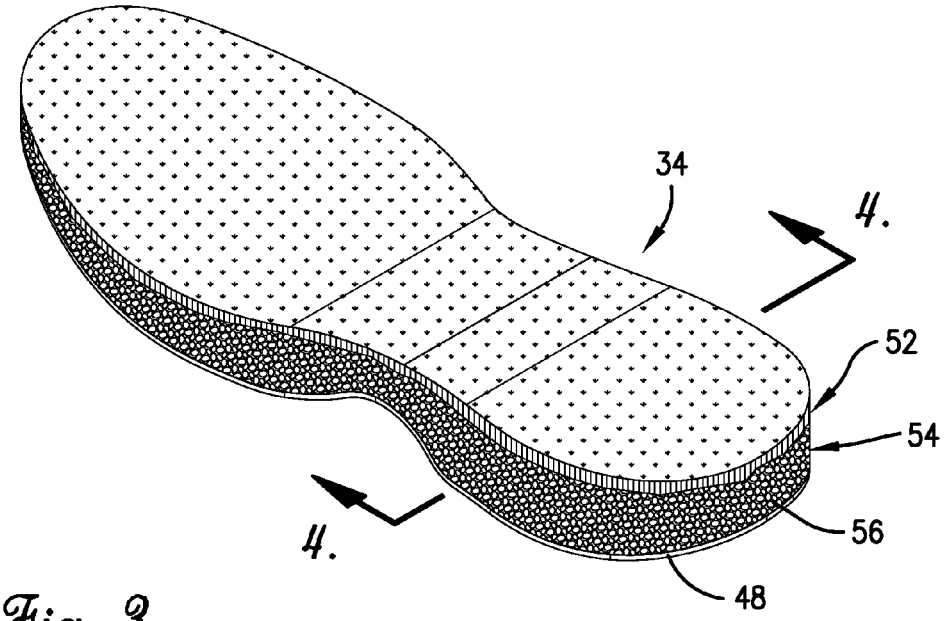
FIG. 3 is a perspective view of the artificial turf section forming part of the improved midsole.
Figure 4:
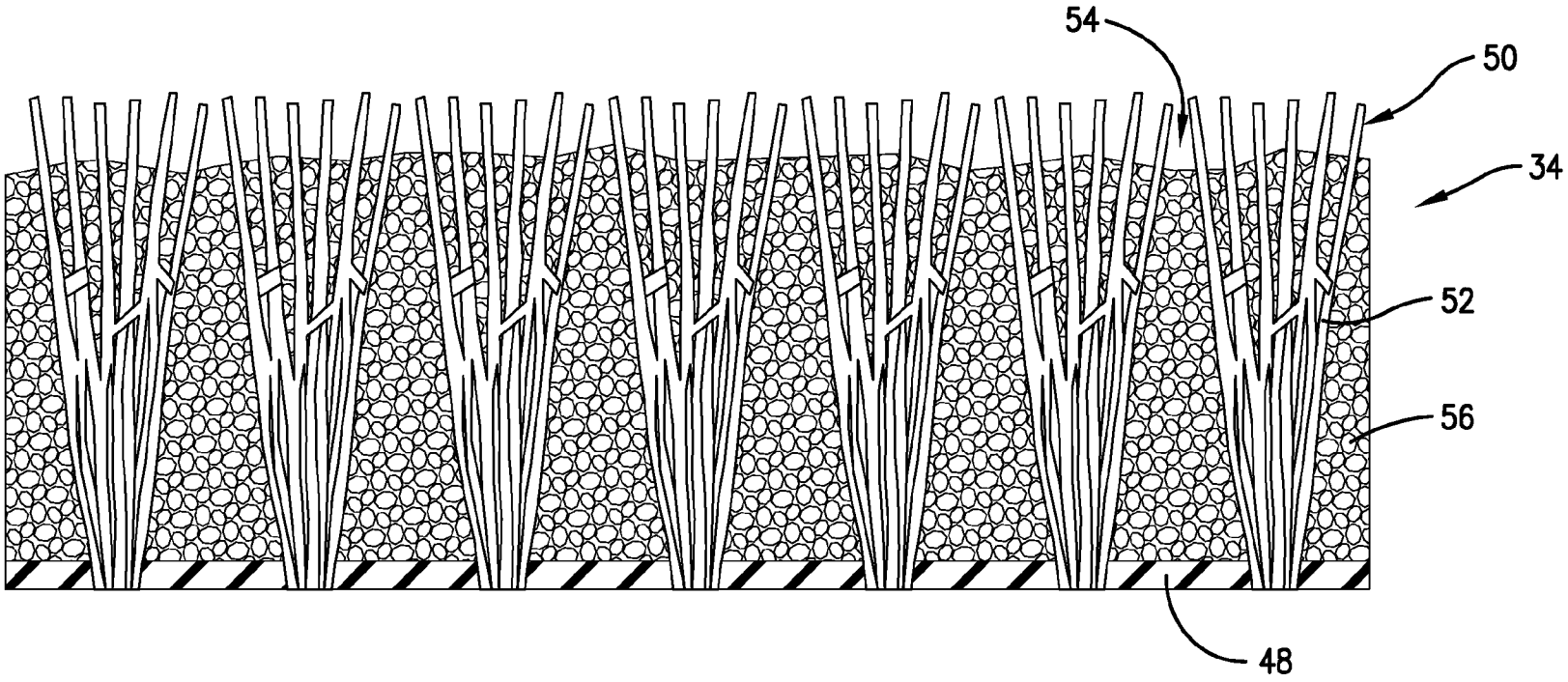
FIG. 4 is a greatly enlarged, fragmentary, vertical sectional view illustrating details of construction of the improved midsole.
Figure 5:
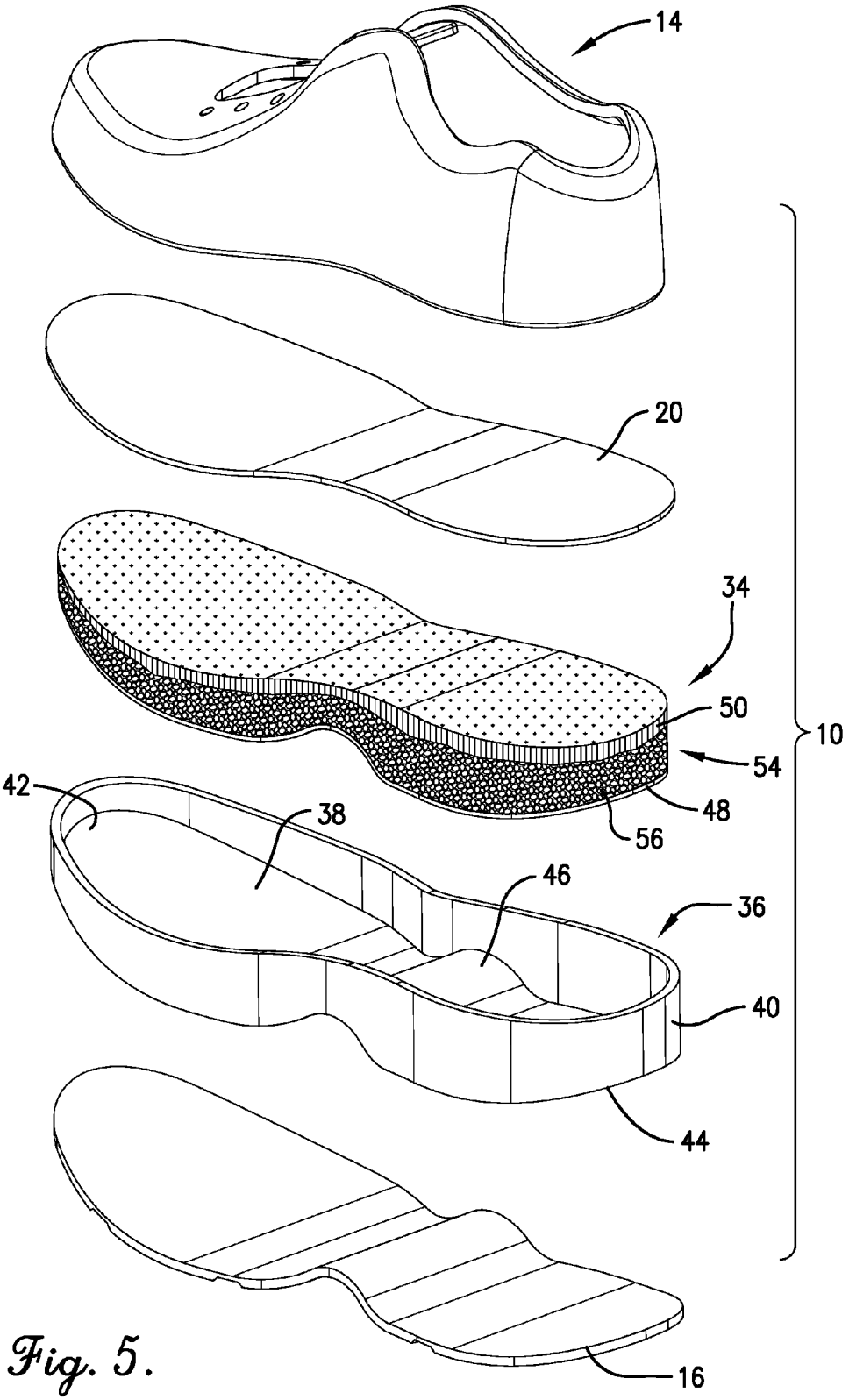
FIG. 5 is an exploded view of the impact absorbing shoe.

The midsole 18 includes as a part thereof a section 34 of artificial turf (FIGS. 3-4). The turf section 34 is located within an open-top housing 36 having a bottom wall 38 and upstanding sidewall structure 40. The housing 36 is preferably formed of a flexible yet shape-retaining synthetic resin material and has a forwardmost toe section 42, rearmost heal section 44, and intermediate arch section 46.

The turf section 34 preferably includes a woven fabric backing sheet 48 and a plurality ofupstanding artificial turf grass fibers 50 secured to sheet 48 and extending upwardly therefrom. The fibers may be of any desired configuration used in the manufacture of artificial turf, such as the illustrated, multiple fiber tufts 52. In the illustrated embodiment, the backing sheet 48 is secured by adhesive to the upper face of bottom wall 38 of housing 36, although other means for securing the turf section 34 in place (e.g., stitching, frictional engagement, etc.) may be employed. Furthermore, according to some aspects of the present invention the backing sheet 48 may alternatively be fixed directly to the outer sole 16. That is to say, the principles of the present invention also encompass a housing without the bottom wall (or without a part thereof), such that the outer sole 16 and sidewall structure 40 cooperatively contain the turf section 34.

The overall turf section 34 further has an infill 54, preferably comprising a particulate elastomeric material, such as elastomeric rubber particles 56. As best seen in FIG. 4, the infill 54 extends along the length of the housing 36 and throughout a substantial portion of the height thereof, to thereby surround the majority of the height of the upright tufts 52. The top margin of housing 36 is covered by the lower face of insole 20, and is attached thereto by adhesive. If desired, the housing may alternatively be provided with its own cover (not shown) that spans (or partially spans) the top opening defined by the upstanding sidewall structure, with such a cover being underneath the insole 20. However, it will be understood that the illustrated artificial turf section 34 is fully encased within the housing 36 and insole 20.

In greater detail, the backing sheet 48 and artificial turf grass fibers 50 can be of any desired type, such as the numerous commercially available artificial turfs, e.g., Astroturf, Superturf, and Fieldturf. More preferably, the pile weight of the turf section 34 is typically on the order of about forty (40) to fifty (50) ounces per square yard. The grass fibers may be formed of any suitable synthetic resin, such as polypropylene, polyethylene, nylon, and mixtures thereof. The grass fibers commonly have a yarn size of from about five thousand (5,000) to about twelve thousand (12,000) denier.

The infill 52 is advantageously formed of particles of resilient rubber material. In the preferred embodiment, the particles have a crumb or particle size of from about one tenth (0.1) to about four (4) mm, and more preferably from about five tenths (0.5) to about three (3) mm. The particles can be formed of any one of a number of elastomeric rubbers, such as natural, polyacrylate, ethylene-acrylate, polyester urethane, bromo isobutylene isoprene, polybutadiene, chloro isobutylene isoprene, polychloroprene, chlorosulphonated polyethylene, epichlorohydrin, ethylene propylene, ethylene propylene diene monomer, polyether urethane, perfluorocarbon, fluoronated hydrocarbon, fluoro silicone, fluorocarbon, hydrogenated nitrile butadiene, polyisoprene, isobutylene isoprene butyl, acrylonitrile butadiene, polyurethane, styrene butadiene, styrene ethylene butylene styrene copolymer, polysiloxane, vinyl methyl silicone, acrylonitrile butadiene carboxy monomer, styrene butadiene carboxy monomer, thermoplastic polyether-ester, styrene butadiene block copolymer, and styrene butadiene carboxy block copolymer rubbers, and mixtures thereof. If desired, other particulate materials may be used with the elastomeric particles, such as fine-grained quartz sand.

The presently most preferred artificial turf material is commercialized by A-Turf® of Cheektowaga, N.Y., under the designation A-Turf Premier XP. This product is of broadloom tufted construction, and has a pile weight of approximately forty-five (45) ounces per square yard, a face yarn of one hundred percent (100%) polyethylene parallel-long slit fiber, a yarn size of about eight thousand (8,000) to about ten thousand (10,000) denier, and a yarn thickness of one hundred (100) microns. The infill comprises ambiently ground styrene butadiene crumb rubber.

Figure 2:
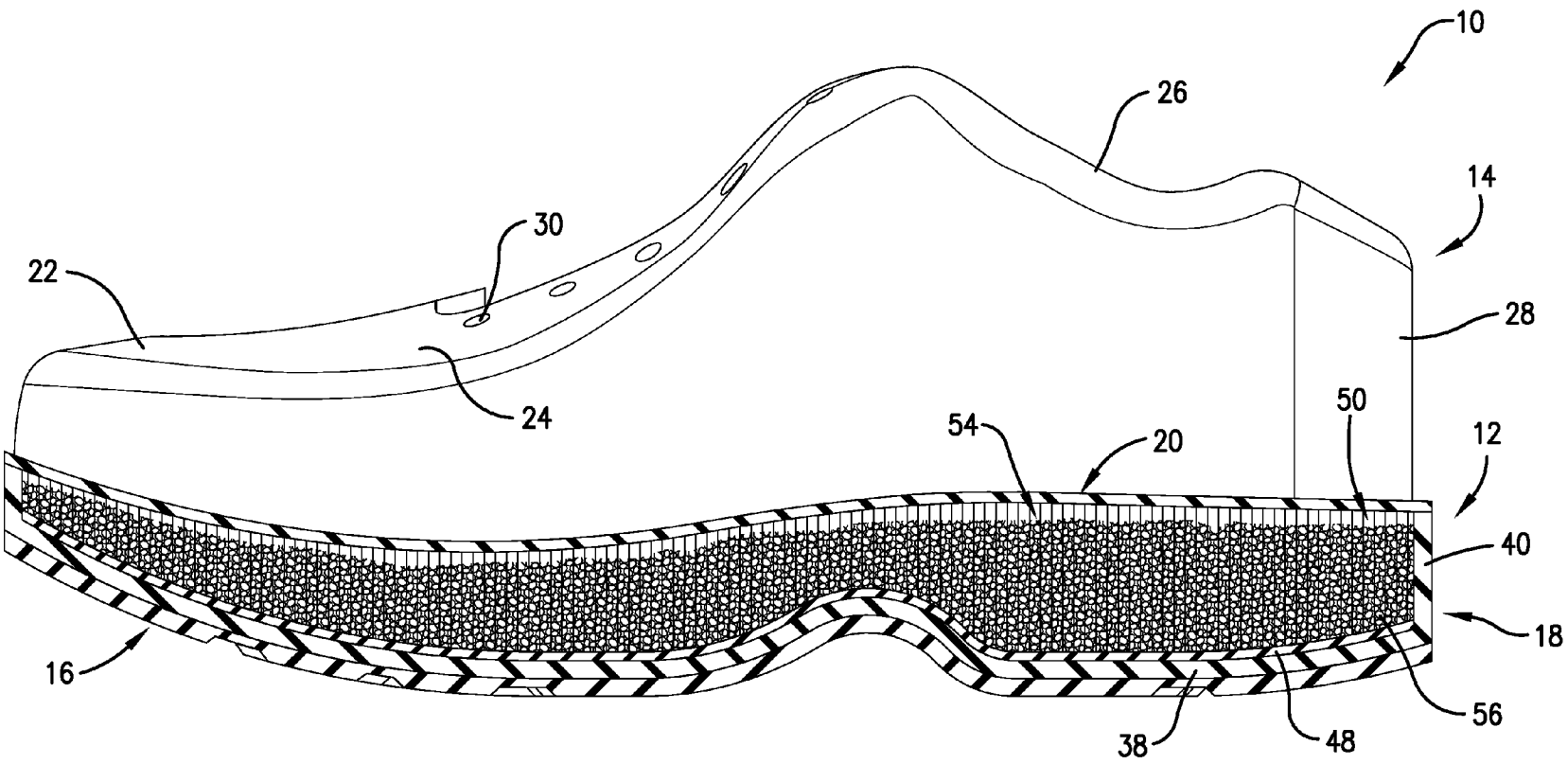
FIG. 2 is a side view illustrating in section an improved midsole forming a part of the impact absorbing shoe.

As best seen in FIG. 2, the outer sole 16 is adhesively secured to the bottom surface of housing wall 48, with insole 20 serving as the top cover for the housing 36 and also as the upper surface of the composite sole 12.

The construction of shoe 10 provides a very comfortable walking and running experience for the wearer, while giving adequate foot and ankle support. Moreover, while the invention has been illustrated in the context of a tennis or athletic shoe, it will be appreciated that virtually any kind of shoe can be improved using a composite sole having a section of artificial turf as a part thereof. Usually, the artificial turf section would be a midsole as depicted, although any section of the sole can contain artificial turf.

Although the above description presents features of preferred embodiments of the present invention, other preferred embodiments may also be created in keeping with the principles of the invention. Furthermore, these other preferred embodiments may in some instances be realized through a combination of features compatible for use together despite having been presented independently as part of separate embodiments in the above description.

The preferred forms of the invention described above are to be used as illustration only and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention set forth in the following claims.

What is claimed is:

1. An impact absorbing shoe comprising:

a composite sole including an outer sole, a midsole, and an insole; and an upper secured to said sole and comprising a toe cap, vamp, and collar, said midsole comprising— a housing including a bottom wall presenting upper and lower faces and upstanding sidewall structure projecting upwardly relative to the upper face of the bottom wall, said upstanding sidewall structure presenting an upper margin of the housing against the insole, said outer sole being secured against the lower face of the bottom wall, a section of artificial turf within said housing and including a backing sheet, a plurality of artificial turf grass fibers secured to said backing sheet and extending upwardly therefrom, and a resilient elastomeric infill above said backing sheet and between said grass fibers, said backing sheet being positioned above the upper face of the bottom wall, said grass fibers extending above the level of said infill, such that a gap is defined between the infill level and the upper margin of the housing, with the gap being at least substantially devoid of infill to thereby facilitate ventilation within the housing, and said insole disposed over said housing to retain the artificial turf section within the housing.

2. The shoe of claim 1 said turf grass fibers formed of synthetic resin material selected from the group consisting of polypropylene, polyethylene, nylon, and mixtures thereof.

3. The shoe of claim 2, said turf grass fibers having a yarn size of from about 5,000 to about 12,000 denier.

4. The shoe of claim 1, said artificial turf having a pile weight of from about 40 to about 50 oz. per square yard.

5. The shoe of claim 1, said infill comprising an elastomeric rubber polymer.

6. The shoe of claim 5, a said elastomeric rubber polymer selected from the group consisting of natural, polyacrylate, ethylene-acrylate, polyester urethane, bromo isobutylene isoprene, polybutadiene, chloroisobutylene isoprene, polychloroprene, chlorosulphonated polyethylene, epichlorohydrin, ethylene propylene, ethylene propylene diene monomer, polyether urethane, perfluorocarbon,fluoronated hydrocarbon, fluoro silicone, fluorocarbon, hydrogenated nitrile butadiene, polyisoprene, isobutylene isoprene butyl, acrylonitrile butadiene, polyurethane, styrene butadiene, styrene ethylene butylene styrene copolymer, polysiloxane, vinyl methyl silicone, acrylonitrile butadiene carboxy monomer, styrene butadiene carboxy monomer, thermoplastic polyether-ester, styrene butadiene block copolymer, and styrene butadiene carboxy block copolymer, and mixtures thereof.

7. The shoe of claim 5, said elastomeric rubber polymer being a cross-linked synthetic rubber.

8. The shoe of claim 5, said infill comprising discrete resilient crumbs, each having an average particle size of from about 0.1 to about 4 mm.

9. The shoe of claim 1, said housing formed of flexible, shape-retaining synthetic resin material.

* * * * *